United States Patent [19]

Iannone

[11] 4,315,551

[45] Feb. 16, 1982

[54] ROD DRIVER

[76] Inventor: Samuel J. Iannone, 15 W. Willow St., Beacon, N.Y. 12508

[21] Appl. No.: 123,390

[22] Filed: Feb. 21, 1980

[51] Int. Cl.[3] ..... B25C 1/00

[52] U.S. Cl. ..... 173/128; 227/147

[58] Field of Search ..... 173/90, 128, 129, 130, 173/131, 132; 227/147

[56] References Cited

U.S. PATENT DOCUMENTS

| | | | |
|---|---|---|---|
| 1,444,834 | 2/1923 | Hindmarsh | 173/130 |
| 1,772,950 | 8/1930 | Joy | 227/147 |
| 2,145,420 | 1/1939 | Hornbecker | 173/128 X |
| 2,430,532 | 11/1947 | Rayburn | 227/147 |
| 2,931,186 | 4/1960 | Frederick | 173/130 |
| 3,381,763 | 5/1968 | Matson | 173/132 X |
| 3,786,847 | 1/1974 | Schera, Jr. | 173/90 X |

*Primary Examiner*—Wm. Carter Reynolds

*Attorney, Agent, or Firm*—Shoemaker and Mattare, Ltd.

[57] ABSTRACT

A rod driver includes an elongate body having a longitudinal bore defined therethrough. A driver head has a curved cutout portion defined therein to cover the bore so the bore has a concave blind end. A rod aft end is impacted by the surface defining the cutout so that any deformation of the rod does not inhibit operation of the rod driver.

2 Claims, 4 Drawing Figures

ROD DRIVER

BACKGROUND OF THE INVENTION

The present invention relates to ground embedded rods, and, more particularly, to a means for driving such rods into the ground.

Many rods must be driven into the ground to carry out the function of those rods. An electrical grounding rod is such a rod. Many electrical grounding rods are formed of a material which can be deformed by impacts delivered thereto. Often, these rods must be driven into ground which is very hard, and thus must be given a large number of extremely forceful impacts to set the rod to the prescribed depth. Such impact setting often distorts the rod aft end into a mushroom shape, and a frayed end results. Such frayed ends are not only aesthetic drawbacks, they may be hazardous as well.

There are many known devices which can be used to drive a rod into the ground. Examples of such devices range from the common hammer to devices such as disclosed in U.S. Pat. Nos. 2,145,420, 1,693,848, 1,661,712 and 2,147,828. However, none of these devices can accommodate a wide variety of grounding rod sizes while permitting the deformation of the grounding rod during the driving process to occur in a manner which facilitates operation of the device.

Accordingly, there is need for a grounding rod driving device which can accommodate a wide variety of grounding rod sizes and which facilitates further and continued operation of the device during the driving process.

SUMMARY OF THE INVENTION

The grounding rod driving device embodying the teachings of the present invention accommodates a wide variety of rod sizes, and causes the grounding rod to deform in a manner which facilitates the further and continued operation of the device.

The driver includes a tubular body having an axial bore defined therethrough. A head is connected to the tubular body and has a cutout region defined therein which is parabolic in shape, and is oriented to be aligned with the tubular body bore. The cutout region is upwardly converging with respect to the bore, and the longitudinal surface of the aft end of the grounding rod contacts the inner surface of the head which defines the cutout region during the driving process. The aft end of the grounding rod is planar and circular in shape, and thus the outer circumferential edge thereof contacts the cutout inner surface which is upwardly converging.

During the driving process, the rod is accommodated within the bore of the tubular body, and the drive is reciprocated up and down on the rod while delivering impacts to the aft end of the rod via the cutout inner surface.

The rod may deform due to the aforementioned impacts. However, due to the upwardly curving convergent nature of the cutout, the rod aft end will not mushroom, but instead, will curve inwardly toward the centerline of that rod. This upward and inward curving of the rod aft end moves that rod out of the way of the rod driver, and thus facilitates further operation of the driver.

Furthermore, the cutout is smoothly curved, and thus can accommodate a wide range of rod outer diameters. The smaller the rod outer diameter, the closer to the heel of the cutout the rod will intersect the cutout surface. The only limitation of rod size is thus the size of the tubular body bore, and the ability of the rod to withstand the impacts of the driver.

OBJECTS OF THE INVENTION

It is a main object of the present invention to provide a rod driver which can accommodate a wide range of rod outer diameters.

It is another object of the present invention to provide a rod driver which is not inhibited by deformation of the rod caused by an embedding process.

These together with other objects and advantages which will become subsequently apparent reside in the details of construction and operation as more fully hereinafter described and claimed, reference being had to the accompanying drawings forming part hereof, wherein like reference numerals refer to like parts throughout.

DETAILED DESCRIPTION OF THE INVENTION

Figure 1:
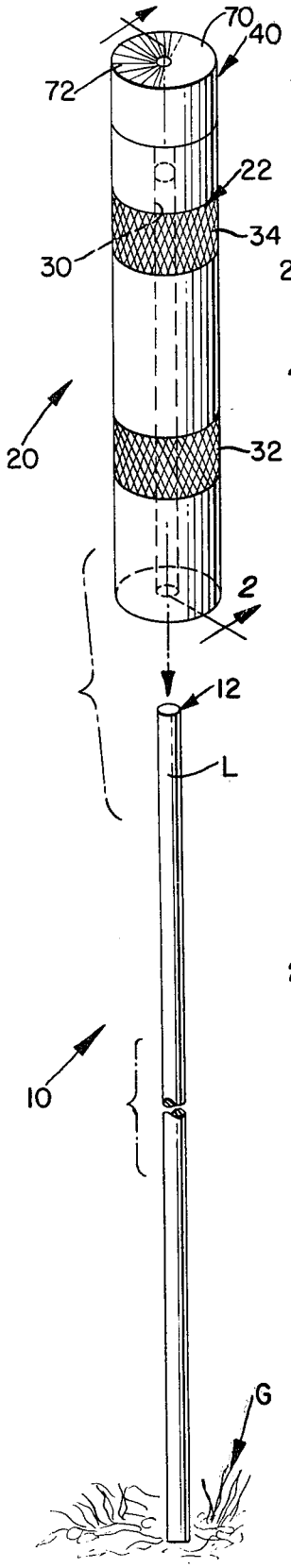
FIG. 1 is a perspective of a rod driver embodying the teachings of the present invention.

Shown in FIG. 1 is a slender rod, such as an electrical grounding rod 10, or the like, which is to be embedded in ground G. The rod has a leading end (not shown) and a following end 12, and is driven into the ground to a prescribed distance. Preferably, the rod 10 is set in the ground by driving.

A hand-held rod driver 20 is shown in the Figures, and is the subject of the present disclosure. As shown, the driver 20 includes a tubular body 22 having a fore end 26 and an aft end 28 and a bore 30 defined axially thereof. The bore 30 has a diameter greater than the diameter of the rod 10 so that any expected size rod can be received within the bore 30 in a free sliding accommodation. Knurling 32 and 34 is located on the outside surface of the tubular body for providing a secure grip. Preferably, the bands of knurling are each four inches wide and are equidistant from the fore and aft ends of the body.

Figure 2:
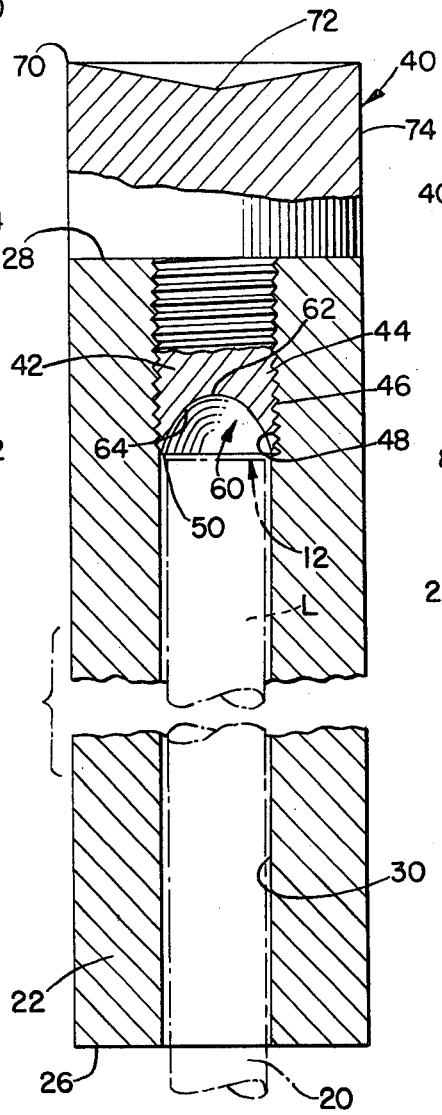
FIG. 2 is a view taken along line 2—2 of FIG. 1.

A driver head is affixed to the aft end of the body, and has an outer diameter essentially matching the outer diameter of the tubular body. One embodiment of the device is shown in FIG. 2, and includes a head 40 which has a boss 42 having external threads 44 defined thereon. The end of the bore 30 adjacent the aft end of the body 22 has internal threads 46 defined on the inner surface 48 thereof for cooperable association with the threads 44 of the head boss. The head is thus threadably attached to the body in the FIG. 2 embodiment.

The boss 42 has a lowermost end 50 which is located within the bore 30 to close off that bore. A parabolic cupola 60 is defined in the boss to open into the bore 30. The bore 30 is thus a blind-ended bore with a concave blind end. The cupola has a heel 62 which is in axial alignment with the longitudinal centerline of the bore so that the cupola has an inner surface 64 which is symmetric with respect to that centerline. The cupola intersects the surface of the boss lowermost end, and is upwardly convergent therefrom. Thus, a continuously converging bore end is defined by the cupola forming cutout portion of the driving head.

The aft end of the rod 10 is contacted by the cupola inner surface 64 during an embedding process. The rod 10 is formed of a deformable material which is deformed from the initially planar shape shown for the aft end thereof in FIG. 1 to the bullet shape shown for the aft end 28' in FIG. 3. The planar end 28 has a circular periphery which corresponds to longitudinal surface L of the rod, and this periphery contacts the inner surface of the cupola during the driving process to force the rod aft end into the cupola. The metal of the rod deforms due to the malleable nature thereof and due to the repeated impacts delivered thereto. However, the cupola serves as a guide to form the deformed rod into a shape which is not only aesthetically pleasing, but which will not inhibit further operation of the head during the driving process. The final configuration of the aft end 28' thus conforms to the shape of the cupola and is accordingly a truncated paraboloid, and can be described, as above, as being bullet-shaped. The end 28' is truncated because the rod 10 contacts the cupola inner surface 64 at a location spaced from the heel 62. The amount of spacing between the heel 62 and the rod aft end is determined by the outer diameter of the rod and the amount of deformation undergone by the rod during the driving process.

The driver head 40 includes an aft end 70 located remote from the boss 42 which is conical in shape. The apex 72 of the cone-shaped end 70 is located within the head 40 so that the cone is inwardly convergent of the head 40. The preferred angle of the cone is 10° with respect to wall 74 of the head 40.

Figure 3:
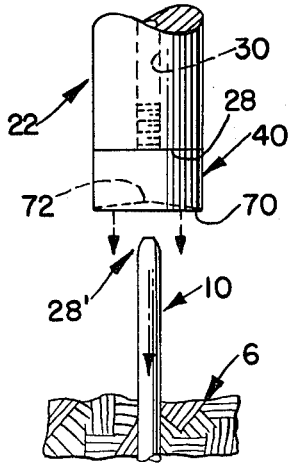
FIG. 3 is a side elevation of the rod driver shown in FIG. 1 inverted from the FIG. 1 position.

Once the rod is driven into the ground a prescribed distance, the rod driver 20 is removed from the rod and inverted as shown in FIG. 3. The conical end of the driver is then used to impact the rod end 28' to complete the driving process.

As above-discussed, the inwardly convergent nature of the cupola prevents the rod aft end from mushrooming out during the driving process. Indeed, the opposite effect occurs, the rod end is deformed inwardly toward a position out of the way of the bore inner surface. Thus, free movement of the rod driver is not impeded by the deformed rod aft end.

Figure 4:
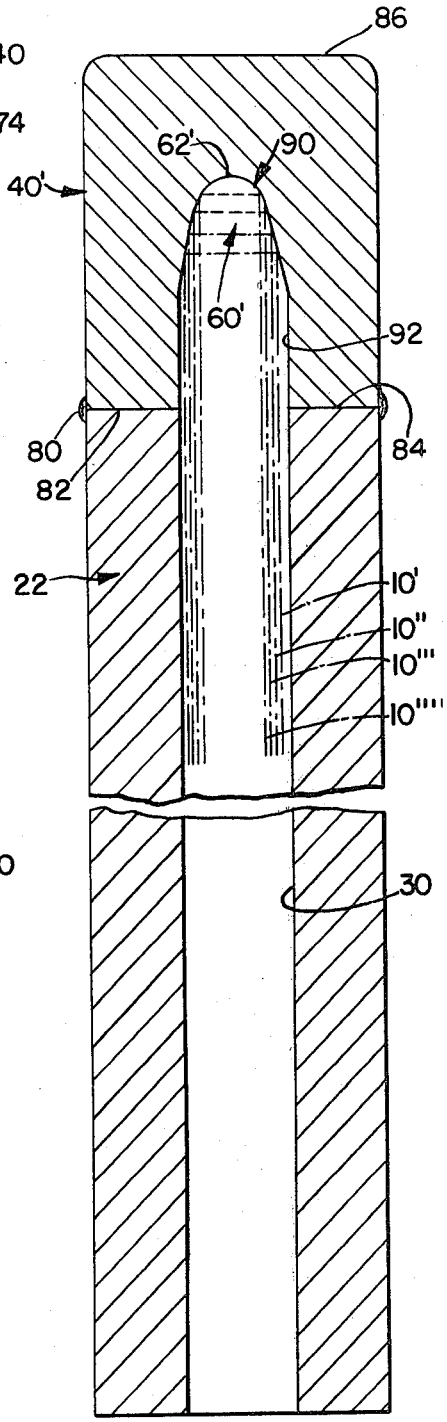
FIG. 4 is a side elevation of another rod driver embodying the teachings of the present invention.

Another embodiment of the driven head is shown in FIG. 4 and is indicated by the reference numeral 40'. The rod head 40' is attached to the tubular body 22 by welds 80, or the like. The head 40' has a fore end 82 in abutting contact with the aft end 84 of the tubular body, and an aft contact with the aft end 84 of the tubular body, and an aft end 86 which is preferably planar, but can have a conical shape similar to aft end 70 of the head 40 if so desired.

A cupola 60' is defined in the head 40' and includes a parabolic end 90 which intersects a tubular bore 92 at a location spaced from the heel 62' of the cupola. The bore 92 is sized and located to be a smooth continuation of the bore 30 of the driver body 22 when the head is mounted on that body.

The cupola 60' operates and functions in a manner similar to the cupola 60, and thus, such operation will not be described.

Other embodiments of the driver head can include a plurality of telescoping sections which change the length of the cupola as measured from the heel section thereof. By moving the telescoping sections, the overall length of the cupola can be changed. Due to the parabolic nature of the cupola, rods having various sizes can be accommodated.

The preferred form of the rod driver 20 accommodates at least three sizes of rods as indicated in FIG. 4. These preferred sizes are $\frac{3}{4}$ inch for rod 10', $\frac{5}{8}$ inch for rod 10'', 9/16 inch for rod 10''' and $\frac{1}{2}$ inch for rod $\mathbf{10}^{IV}$. These rods are shown in FIG. 4 for convenience, and it is to be understood that the FIG. 3 embodiment of the rod driver accommodates the same rod sizes which are not shown in FIG. 3 only for the sake of clarity, and no limitation is intended. Other rod sizes can also be accommodated, if so desired.

The driver head is preferably an alloy hardened to a Rockwell hardness of 50–53, and the tubular body is preferably cold rolled steel.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

I claim:

1. A rod driver comprising:

an elongate body having a fore end and an aft end and a rod receiving bore defined longitudinally therethrough;

a driving head threadably mounted on said body aft end, said driving head having a boss projecting into said rod receiving bore, said boss forming a bore covering portion covering said rod receiving bore and a cutout portion defined in said boss, said cutout being curved outwardly of said bore so that said bore has a concave blind end adjacent said body aft end, whereby, a rod received in said rod receiving bore has one end thereof contacting a surface defining said cutout portion so that any deformation of said rod one end caused by impact between said driving head cutout portion defining surface and said rod one end is controlled by the shape of said cutout portion.

2. The rod driver defined in claim 1 wherein said driving head includes an aft end which is conical in shape and has the apex thereof located inwardly of said driving head.

* * * * *